US005580666A

United States Patent [19]

Dubensky et al.

[11] Patent Number: 5,580,666

[45] Date of Patent: Dec. 3, 1996

[54] CEMENTED CERAMIC ARTICLE MADE FROM ULTRAFINE SOLID SOLUTION POWDERS, METHOD OF MAKING SAME, AND THE MATERIAL THEREOF

[75] Inventors: Ellen M. Dubensky; Stephen D. Dunmead; Daniel F. Carroll, all of Midland, Mich.

[73] Assignee: The Dow Chemical Company, Midland, Mich.

[21] Appl. No.: 375,759

[22] Filed: Jan. 20, 1995

[51] Int. Cl.[6] ..... B22F 7/06

[52] U.S. Cl. ..... 428/552; 428/546; 428/548; 428/551; 428/567

[58] Field of Search ..... 428/212, 546, 428/548, 551, 552, 567; 75/229, 233, 236, 238, 241; 408/144; 501/93

[56] References Cited

U.S. PATENT DOCUMENTS

| | | | |
|---|---|---|---|
| 3,971,656 | 7/1976 | Rudy | 75/203 |
| 4,265,662 | 5/1981 | Miyaki et al. | 75/238 |
| 4,279,651 | 7/1981 | Fujimori et al. | 75/233 |
| 4,290,807 | 9/1981 | Asai et al. | 75/233 |
| 4,300,952 | 11/1981 | Ingelstrom et al. | 75/238 |
| 4,915,734 | 4/1990 | Brandt et al. | 75/229 |
| 4,935,057 | 6/1990 | Yoshimura et al. | 75/238 |
| 4,963,183 | 10/1990 | Hong | 75/241 |
| 4,971,485 | 11/1990 | Nomura et al. | 408/144 |
| 4,973,355 | 11/1990 | Takahashi et al. | 75/233 |
| 5,173,107 | 12/1992 | Dreyer et al. | 75/229 |
| 5,188,489 | 2/1993 | Santhanam et al. | 407/119 |
| 5,266,388 | 11/1993 | Santhanam et al. | 482/212 |
| 5,288,676 | 2/1994 | Shimada et al. | 501/93 |
| 5,306,326 | 4/1994 | Oskarsson et al. | 75/238 |
| 5,308,376 | 5/1994 | Oskarsson | 75/238 |
| 5,314,657 | 5/1994 | Ostlund | 419/15 |
| 5,330,553 | 7/1994 | Weinl et al. | 75/236 |
| 5,364,209 | 11/1994 | Santhanam et al. | 407/119 |

*Primary Examiner*—Charles T. Jordan
*Assistant Examiner*—John N. Greaves

[57] ABSTRACT

A multi-phase cemented ceramic article, method of making same, and the material thereof is disclosed which is useful for machining and forming of metals, including ferrous metals, titanium, aluminum and other metals. The article and its material preferably includes novel microstructures including platelets, a range of grain sizes which yields superior hardness and other characteristics, and a lower tungsten concentration within the binder phase than has been seen in the prior art. The preferred composition includes ultrafine WC, an ultrafine solid solution of (Ti, Ta, W)C, and a cobalt binder. Platelets are formed in-situ, eliminating the need to add them during manufacture for improving toughness.

23 Claims, 3 Drawing Sheets

CEMENTED CERAMIC ARTICLE MADE FROM ULTRAFINE SOLID SOLUTION POWDERS, METHOD OF MAKING SAME, AND THE MATERIAL THEREOF

TECHNICAL FIELD

This invention relates to cemented ceramic tools, methods for making same, and the materials of which the tools are composed, and especially to a cemented carbide tool made of a two or more constituent multi-phase material including, among other materials, an ultrafine solid solution of hard materials.

BACKGROUND OF THE INVENTION

Historically, cemented carbides were invented in the 1930's for use as tool bits, machining tools, and the like. Machining was the rate determining factor in the tooling industry, so it was important to obtain tooling which could withstand high speed machining to increase the productivity of the process.

Then, changes in automation saved time in the machining process by loading, unloading, moving and inspecting with machines and robots. This meant that the greatest amount of time was saved due to the elimination of human interaction. Now, again, the time spent on machining is getting renewed interest because it is once again a large percent of the time spent on a tool. As computers take over more and more of the operation, it becomes important to optimize our machining capabilities by increasing the speed of milling and cutting.

Developments are being made in the area of new tool materials that will be better than traditional materials in three ways. The first two ways are directed toward prevention of catastrophic failures, i.e. 1) fracture resistance, and 2) resistance to plastic deformation; while the third way, i.e. resistance to wearing, is directed to the gradual wearing down of the tool.

Fracture resistance, of course, refers to the resistance to pieces of the tool being severed, or fractured, while work is in progress. Measurements of transverse rupture strength, although not directly correlated to fracturing, seem to be the best indicator of fracture resistance. Those materials with high transverse rupture strength are normally less prone to fracture. The following is a listing of the transverse rupture strengths for the most commonly used cutting tool materials.

| Tool material | Transverse Rupture Strength GPa | (psi) |
|---|---|---|
| pure $Al_2O_3$ | 0.69 | (100,000) |
| Sialon | 0.75 | (125,000) |
| CBN (Amborite ®) | 0.57 | (113,000) |
| Cemented WC | 1.4–2.8 | (200–400,000) |
| Coated WC | 1.0–2.1 | (150–300,000) |
| High speed steel | 2.8+ | (400,000+) |

"Amborite ®"is a registered trademark of DeBeers, Johannesburg, South Africa.

It may be noted that the cemented WC has the highest transverse rupture strength. It may also be noted that high speed steel also has a very high value. This generally indicates that tool parts can be made into more complex geometries, including more positive rake angles and smaller edge-included angles. Another feature which may seem odd is that the coated WC has a lower value than the cemented WC. Although the coating may serve to extend the life of the carbide tool, it also acts as an area where cracks may initiate due to the bonding stresses at the interface between the substrate and the coating. These figures tend to dispel the misconception that the presence of a wear resistant coating relaxes the requirements on the substrate. Rather, the substrate is now required to have increased hot strength, and be more resistant to fracture.

Secondly, resistance to plastic deformation simply means that the tool material must have sufficient high temperature strength to maintain its shape at cutting temperatures. If the substrate begins to get "mushy" at the higher temperatures which are experienced during the cutting and milling operations, catastrophic failure will take place. Obviously, the melting point of the workpiece sets the temperature limit on the cutting temperature (assuming the melting point of the tool exceeds that of the workpiece). Below is a table which contrasts the softening point of various tooling materials to the melting point of common workpiece materials.

| Tool material | (Softening Point) | Workpiece Material | (Melting point) |
|---|---|---|---|
| High Speed Steel | 873 K | Aluminum | 873–933 K |
| Cemented WC | 1373 K | Superalloys | 1573–1673 K |
| Aluminum Oxide | 1673 K | Steel | 1723–1773 K |
| Cubic Boron Nitride | 1773 K | Titanium | 1873–1923 K |
| Diamond | 1773 K | Zirconium | 2073–2123 K |

Consequently, it can be seen that a wear resistant coating needs a substrate of greater hot strength to withstand the higher temperatures allowed by the wear resistant coating, without "deforming" and causing failure.

The tool failures which occur due to fracture or deformation are catastrophic and happen all at once. These types of failures disrupt a conventional factory, and cannot be tolerated in an automated machining system. If these catastrophic failures can be prevented, the goal of a tool manufacturer is to provide a material which is hard and tough enough to withstand wear for an extended period of time. Generally, at moderate cutting speeds, the life of the tool is determined by excessive rubbing of the tool on the workpiece surface. At higher speeds, crater wear is the main concern, with the crater deepening until edge failure results.

Many companies are trying new tool materials in order to increase fracture resistance, resistance to tool deformation, and resistance to wear. A significant number of companies are making cemented carbides, i.e. tungsten carbide (WC) powder mixed with cobalt metal, as a binder, pressed into the shape of the tool and sintered. A coating may also be preferred depending on the application. It has also been shown that various additives can enhance certain properties, and depending on the workpiece being cut or milled, individual properties may need to be enhanced. These properties include hardness, toughness, plastic deformation at high temperatures, crater resistance, and wear resistance. Solid solutions have been proposed, as well as metallic carbides, carbonitrides, and nitrides.

Prior patents have stated that tantalum (Ta) has been substituted into the base tungsten carbide composition in order to increase toughness, while chromium (Cr) improves corrosion resistance, and titanium (Ti) increases Vickers hardness values. Zirconium and hafnium appear to contribute to wear resistance, while other additives enhance other properties. U.S. Pat. No. 5,364,209, issued Nov. 15, 1994 to Kennametal Inc. of Latrobe, Pa. discloses a coated cutting tool with a substrate composed of a WC based solid solution cemented carbide material having at least 70 weight percent WC, and Ta 0–12 wt. %, Ti 0–10 wt. %, and a small amount of chromium, with a metallic binder of 8–12 wt. % Cobalt. A CVD and a PVD coating was deposited onto the substrate.

U.S. Pat. No. 5,330,553, issued Jul. 19, 1994 to Sandvik AB of Sandviken, Sweden discloses a sintered carbonitride alloy with highly alloyed binder phase containing hard constituents based on, in addition to Ti, W and/or Mo, one or more of the metals Zr, Hf, V, Nb, Ta or Cr in a 5–30 Wt % binder phase based on cobalt and/or nickel. The grain size of the hard constituents is stated to be generally less than 2 micrometers.

U.S. Pat. No. 5,288,676, issued Feb. 22, 1994 to Mitsubishi Materials Corporation, of Tokyo, Japan discloses a WC/Co matrix (grain size 0.2–1.5 micrometers) incorporating a (Ta: Ti)C solid solution (grain size 1.0–2.0 micrometers), along with unavoidable impurities of calcium, sulfur, aluminum, silicon and phosphorus. It is also stated at column 2, lines 51–55 that WC is not available with a grain size of less than 0.2 micrometers on an industrial basis. So, the disclosed WC powders are all larger than 0.2 micrometers.

U.S. Pat. No. 4,971,485, issued Nov. 20, 1990 to Sumitomo Electric Industries, Ltd. of Osaka, Japan discloses a drill having a shank portion made of cemented tungsten carbide having a restricted particle size of not more than 0.7 micrometers in order to attain sufficient strength against breaking. It also includes nitrogen in the cemented carbide in order to suppress grain growth of hard dispersed particles during sintering. Example 1 shows a composition of WC, (Ti:W)C solid solution, TaC, and NbC as the hard constituents, with Co as the binder phase.

It is clear, therefore, that it would be an advantage to have a tool and its corresponding material which would exhibit superior hardness, toughness, and wear resistance. The same advantages are clearly amenable to usage in tool inserts, tool substrates, and metal forming dies. Although prior art cemented carbides have been superior in wear resistance, they have been susceptible to breakage during use due to their inferiority in hardness and toughness. This is especially true when the requirements for high speed cutting and milling have placed their performances on the line, where the new machining apparatuses need tools which can achieve higher speed operations.

SUMMARY OF THE INVENTION

In accordance with the preferred embodiment of the present invention, this and other advantages are addressed as follows. A tool having improved hardness characteristics is disclosed which is useful in the machining and forming of metals, tool inserts, tool substrates, and metal forming dies. The tool is made of a multi-phase cemented ceramic material which includes at least two types of hard phase constituents, including a first type of hard phase constituent selected from the group consisting of the carbides, nitrides, carbonitrides, carboxynitrides, and mixtures thereof of Group IVB (Ti, Zr, Hf), Group VB (V, Nb, Ta), Group VIB (Cr, Mo and W) transition metals; a second type of ultrafine solid solution hard phase constituent, wherein the ultrafine solid solution hard phase is made from grains having a number average particle diameter of between about 0.01 and about 1.0 micrometers, said solid solution hard phase constituent selected from the group consisting of the carbides, nitrides, carbonitrides, carboxynitrides, and combinations thereof, of at least two metallic elements from Group IVB (Ti, Zr, Hf), Group VB (V, Nb, Ta), and Group VIB (Cr, Mo and W) transition metals; and a metallic binder phase selected from the group consisting of Group VIII elements (Co, Ni, Fe), Group IVB (Cr, Mo, W) and mixtures thereof. The tool is processed by the method detailed below, and details of the preferred embodiment will also be discussed hereinbelow.

A method for making the abovementioned tool is also disclosed. The steps for the method include homogeneously mixing together at least two types of powdered hard phase constituents with a powdered binder phase constituent to form a starting powder mixture, and the constituents are the same as described above in terms of the tool. After mixing the starting powders, they are combined with a wax and mixed with the powder mixture to form a moldable mass. The moldable mass is then pressed into a tool-shaped mass, and the tool-shaped mass is dewaxed by placement in a furnace and elevating the temperature at a rate of from about 0.5 K/min to about 10 K/min up to a temperature of from about 453 K to about 543 K for a time of from about 1 min to about 20 min, followed by ramping up the temperature of the tool-shaped mass at various rates of from about 0.5 K/min to about 10 K/min up to a temperature of from about 1673 K to about 1773 K with intermediate holding periods at specified temperatures to permit the removal of residual carbon, degassing, melting of the binder phase, and sintering of the tool-shaped mass into the cemented ceramic tool.

Furthermore, a material useful in the tooling industry is disclosed which includes at least two types of hard phase constituents, including a first type of hard phase constituent selected from the group consisting of the carbides, nitrides, carbonitrides, carboxynitrides, and mixtures thereof of Group IVB (Ti, Zr, Hf), Group VB (V, Nb, Ta), Group VIB (Cr, Mo and W) transition metals; a second type of ultrafine solid solution hard phase constituent, wherein the ultrafine solid solution hard phase is made from grains having a number average particle diameter of between about 0.01 and about 1.0 micrometers, said solid solution hard phase constituent selected from the group consisting of the carbides, nitrides, carbonitrides, carboxynitrides, and combinations thereof, of at least two metallic elements from Group IVB (Ti, Zr, Hf), Group VB (V, Nb, Ta), and Group VIB (Cr, Mo and W) transition metals; and a metallic binder phase selected from the group consisting of Group VIII elements (Co, Ni, Fe), Group IVB (Cr, Mo, W) and mixtures thereof. A material is produced which, when homogeneously mixed, pressed and sintered, exhibits superior hardness ranging between about 1600 and about 2100 $Kg/mm^2$.

Preferred embodiments and optimized selections will depend upon the workpiece which is being milled or cut by the tool of the present invention. One of ordinary skill in the art will know of obvious modifications and alterations which will produce the finest tool for any particular application.

The invention will become clear to one of ordinary skill in the art upon reviewing the detailed description, the following description of the photographs, and the appended claims.

DETAILED DESCRIPTION OF THE INVENTION

Figure 1:
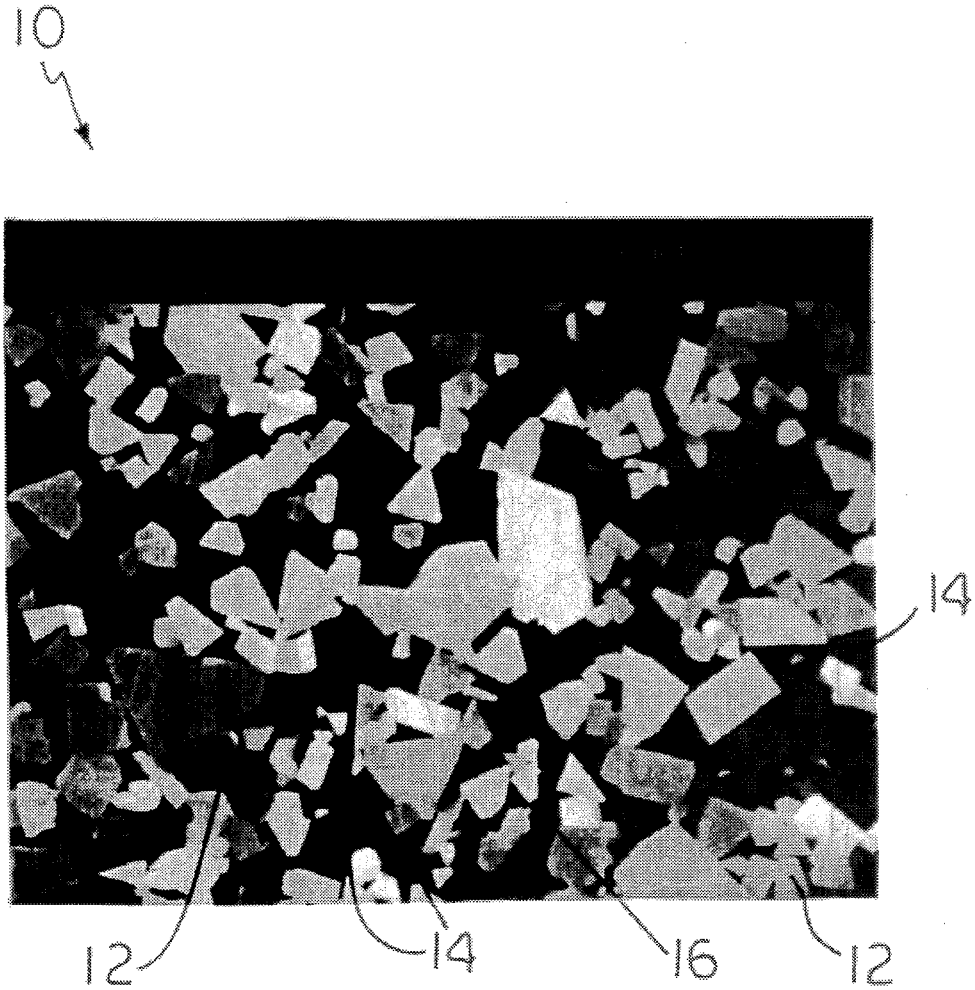
FIG. 1 is an SEM photomicrograph of one of the best conventional prior art tooling materials, taken at 5000 X magnification, in which tungsten carbide and cubic solid solution carbide grains can be seen.

The tool manufactured in accordance with the present invention generally includes a cemented ceramic tool useful in the machining and forming of metals. The present invention exhibits an especially advantageous hardness over the prior art devices, as can be seen from the following data and the appending photomicrographs.

The preferred embodiment of the present invention includes a tool made of a material including at least two types of hard phase constituents. These constituents include a first type of hard phase constituent consisting of tungsten carbide, present in the amounts of between about 50% and about 80%, by volume in the bulk of the resultant tool, a second type of ultrafine solid solution hard phase constituent including a solid solution of the carbides of titanium, tantalum and tungsten present in the amount of between about 10% and about 50%, by volume in the bulk of the resultant tool, and a cobalt binder phase, present in the amount of between about 5% and about 30%, by volume in the bulk of the resultant tool. A tool formed of such a material includes multiple phases after sintering, including two distinct grain size ranges of the WC, the first grain size range including platelets of a coarser tungsten carbide, and finer tungsten carbide grains of a number average particle diameter between about 0.10 and about 0.40 micrometers, the coarser tungsten carbide and a relatively low tungsten concentration in the cobalt binder phase.

The preferred embodiment of the tool has substantially discrete ranges of grain sizes within the first type of hard phase constituent, which is made of predominantly two separate grain sizes, the first grain size being from about 2.0 to about 4.0 times the size of the second grain size. It is speculated that this new microstructure might yield the extra hardness. Another novel microstructure in the material includes the first hard phase constituents being in the form of platelets.

These platelets have an average aspect ratio ranging from about 1.5 to about 3.0, with a number average equivalent circular diameter of between about 0.30 to about 0.85 micrometers.

Furthermore, it is preferred for the first type of constituent to include tungsten carbide, while the second type of hard phase constituent preferably includes a solid solution of the carbides of titanium, tantalum and tungsten, wherein the weight percentages of the resulting individual metallic elements of the (Ti,Ta,W)C solid solution include about 10% to about 40% by weight titanium, from about 10% to about 40% by weight of tantalum, and from about 20% to about 60% by weight of tungsten, within the solid solution carbide in the bulk of the tool.

It is thought that the platelets add toughness to the material, and help deflect cracks which may begin to propagate in the material. This technique of adding platelets is used in other ceramic industries, to the extent that platelets are added to other ceramic mixtures for this purpose. However, in this case, the present invention gives an additional advantage in that the platelets are formed in-situ, thereby eliminating the need for adding platelets. In addition, because the platelets are formed in situ, the grain boundary should contain less residual oxide contaminant and be much cleaner. Besides the fact that the inventors do not know of a source of tungsten carbide platelets at a reasonable price, it eliminates the cost of having to add them. This will also give the present invention a cost advantage over any other such material that requires the addition of such platelets.

The multiple phases in the finished tool preferably include a fine tungsten carbide phase, a coarse tungsten carbide phase, a solid solution phase of (Ti, Ta, W)C, and a cobalt-containing metallic binder phase, wherein the volume percentages of each of the phases in the finished tool range from about 10% to about 50% fine tungsten carbide, from about 10% to about 75% coarse tungsten carbide, from about 10% to about 50% solid solution of the carbides of titanium, tantalum and tungsten, and from about 5% to about 30% binder phase. It should be noted that a triple metal solid solution carbide of (Ti, Ta, W)C generally has a cubic morphology.

Yet another advantage in the present invention arises due to the novel metallic binder phase in the finished tool which includes cobalt with a minor amount of tungsten therein, said minor amount being from about 4% to about 15%, by weight. Prior art materials contained more than 19% by weight of tungsten in the cobalt. This new binder chemistry, with its lower tungsten concentration in the binder, is thought to improve the characteristics of the tool.

The tungsten carbide powders may contain small amounts, typically less than 1.0 wt % of carbides of Groups IVB, VB, and VIB elements, as grain growth inhibitors.

The material as claimed below is made of the same material as is used in the tool, described in great detail above, and the description will not be repeated here, as it is believed to be described in sufficient detail above, and the following Examples will further describe the material of the present invention.

A method for producing the cemented ceramic tool is also disclosed which includes the steps of homogeneously mixing together at least two types of powdered hard phase constituents with a powdered binder phase constituent to form a starting powder mixture. These constituents include the same components as were described above with respect to the tool, so they will not be repeated here. After mixing, a wax is combined with the starting powder mixture to form a moldable mass. Then, by pressing the moldable mass into a tool-shaped mass, an article is made which can be placed into a furnace. Dewaxing the tool-shaped mass is accomplished by elevating the temperature at a rate of from about 0.5 K/min to about 10 K/min up to a temperature of from about 453 K to about 543 K for a time of from about 1 min to about 20 min. Then, this dewaxing step is followed by ramping up the temperature of the tool-shaped mass at various rates of from about 0.5 K/min to about 10 K/min up to a temperature of from about 1673 K to about 1773 K with intermediate holding periods at specified temperatures to permit the removal of residual carbon, degassing, melting of the binder phase, and sintering of the tool-shaped mass into the cemented ceramic tool.

Mixing of the starting powders is accomplished by attriting in heptane for a time of between about 2 and about 10 hours with a milling media of WC/Co balls, followed by mixing in paraffin wax in a weight percent of between about 0.5% and about 8%, with respect to the weight of the starting powder mixture. As one of ordinary skill in the art will be aware, the milling times will change depending upon the method of milling, and, of course, there is no real upper limit to the time period during which milling can take place.

The step of pressing the moldable mass into a tool-shaped mass is preferably accomplished by uniaxially pressing, although pressing may also be accomplished by cold isostatic pressing, injection molding, and extrusion, among others.

After the dewaxing step, the ramping of the furnace temperature is designed to ultimately result in the sintering of the tool, followed by cooling down the heat treated tool by turning off the furnace and allowing the heat treated tools to remain in the furnace until the furnace is substantially at ambient temperature.

An additional optional step of pressure densification of the tool after it has been sintered may help to close voids and increase strength. Possible densification techniques for this step may include hot isostatic pressing (HIP), and rapid omnidirectional compaction (hereinafter "ROC").

ROC is taught, in its various aspects by Timm in U.S. Pat. No. 4,744,943, Lizenby in U.S. Pat. Nos. 4,656,002 and 4,341,557, Rozmus in U.S. Pat. No. 4,428,906 and Kelto in the book "Metals Handbook" in an article called "Rapid Omnidirectional Compaction", Volume 7, pages 542–546. These references are incorporated herein by reference.

Referring now to FIG. 1, a prior art conventional tool from Kennametal, Inc. of Latrobe, Pa. is illustrated. From the photomicrograph, it can be seen that, at 5000 X magnification, their material has much larger grain sizes than will be seen later in our material. The material is generally referred to by numeral 10, while the tungsten carbide of their composition is shown as 12. Both the white and the lighter grey particles are tungsten carbide with an angular morphology, having a number average particle diameter of about 1.1 micrometers. The dark grey spherical particles, shown as 14, are cubic solid solution carbide of titanium, tantalum and tungsten, having a number average particle diameter of about 1.3 micrometers. The black substance between the abovementioned particles is the cobalt binder 16. The properties of the material are more fully described hereinbelow under "Comparative Example".

Figure 2:
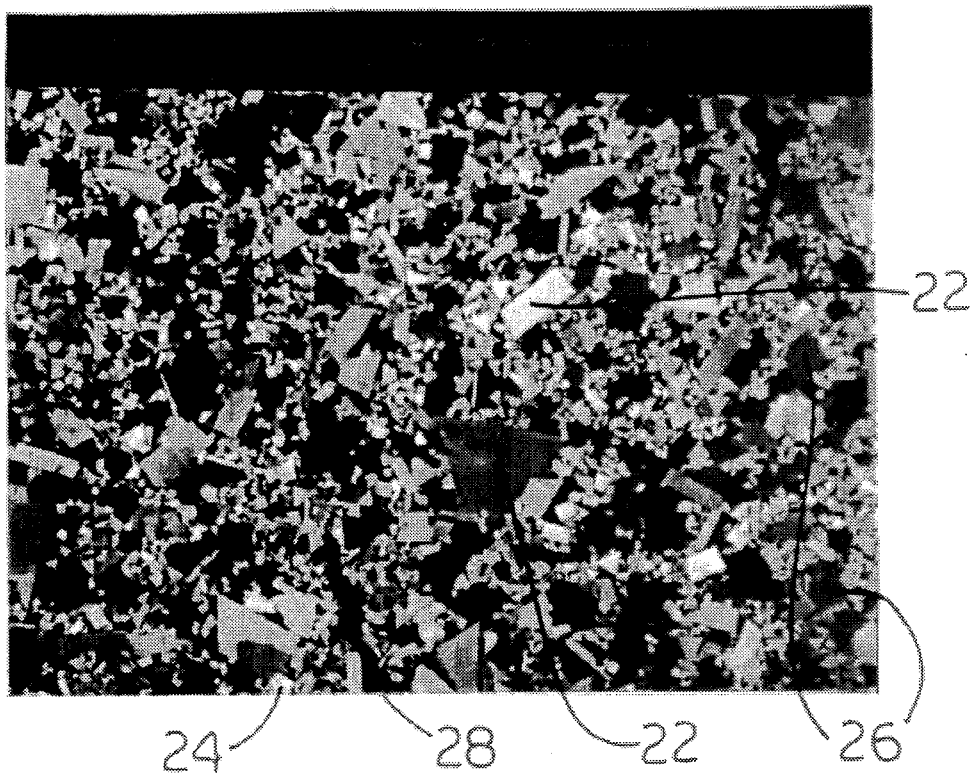
FIG. 2 is an SEM photomicrograph of one of our preferred embodiments of a sintered tool material made in accordance with the present invention, at the same magnification as the prior art shown in FIG. 1, for comparison sake, and it shows our novel microstructures (including the cubic solid solution and the two distinct grain sizes of the tungsten carbide fines, the coarser tungsten carbide platelet structure, and the solid solution cubic carbide structure).

Looking now to FIG. 2, the tool of the present invention is shown. The tool material is generally denoted by numeral 20, while the coarse tungsten carbide platelets 22 are seen as the white and light grey plates. The fines of tungsten carbide 24, are seen as tiny white-to-light grey angular particles. The dark grey spherical particles 26 are a cubic solid solution carbide of titanium, tantalum and tungsten. Again, the black substance between the particles is the cobalt binder 28. The properties of our material is more fully described hereinbelow under Example 3, where a full comparison is done between the prior art and our material.

Figure 3:
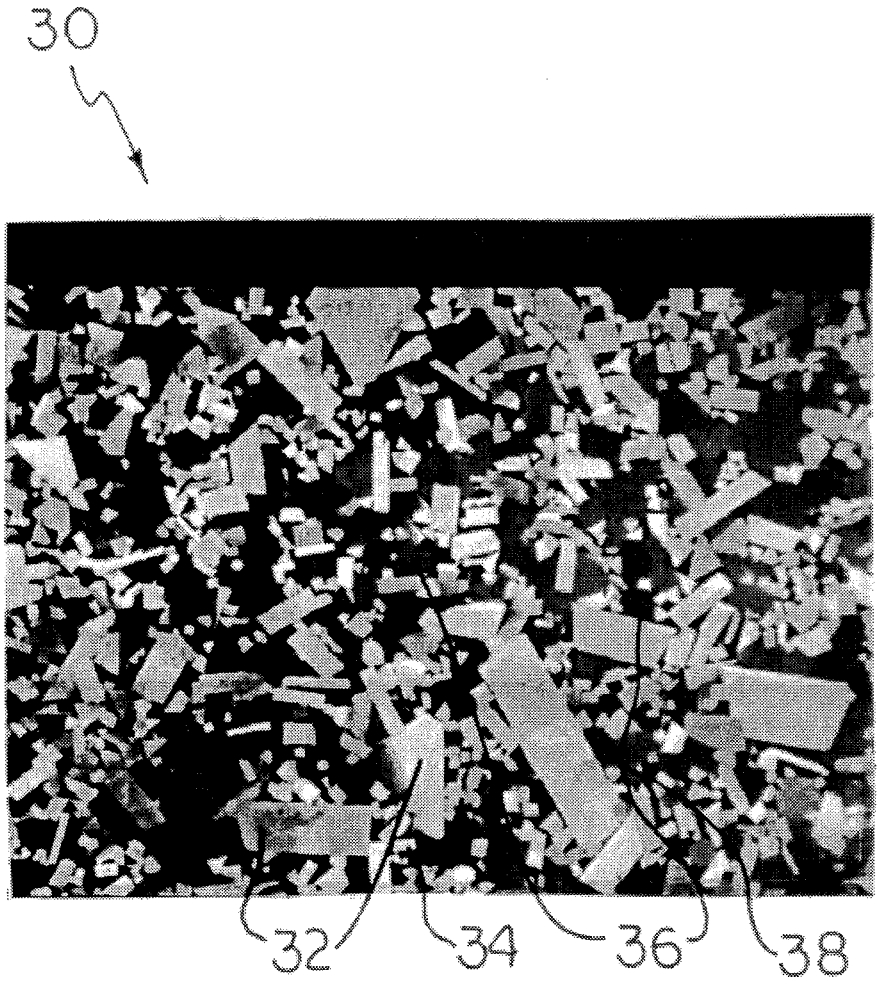
FIG. 3 is another SEM photomicrograph, at the same 5000 X magnification, and it clearly illustrates the cubic solid solution and the distinct dual grain size ranges, the platelet structure of larger, coarser tungsten carbide grain, and a second, finer tungsten carbide grain.

FIG. 3 shows the material of the present invention, and is generally designated by numeral 30. Coarse tungsten carbide platelets 32 are seen as white-to-light gray angular particles, while the fines 34 of tungsten carbide can also been seen. Dark gray spherical particles 36 are a cubic solid solution carbide of titanium, tantalum and tungsten. Cobalt binder 38 binds the particles. Again, this material is more fully described herein below with reference to Example 1, where a description of the plate morphology and the submicron solid solution is given.

The following examples will serve to illustrate the present invention, showing the properties of the finished, sintered tool, and will compare our new material to the prior art material of Kennametal, Inc. of Latrobe, Pa., a close material to ours. The scope of the invention is not meant to be limited by the given Examples, but they are rather given here to be illustrative.

EXAMPLES 1–5

The following paragraphs first discuss one of the best prior art materials from Kennametal. Next, we will discuss the production of our three different lots of starting powder, CWC-050, CWC-059, and CWC-060. Following that, we discuss the actual tool material made from those starting powders. One will notice our superior hardness characteristics.

Comparative Example: Commercial Cutting Tool Grade K420

A prior art cutting tool material, K420 from Kennametal, Inc. (Latrobe, Pa., USA), was analyzed for properties and microstructure. Physical property testing of their prior art material provided the following results:

Density: 12.69 g/cm$^3$ Hardness, Vickers (31.8 kg load, 15 sec dwell): 1506±5 kg/mm$^2$ Palmqvist Toughness (31.8 kg load): 109.5±4.4 kg/mm Analytical work involved the use of metallography, light microscopy, analytical scanning electron microscopy (ASEM), analytical transmission electron microscopy (ATEM), and X-ray diffraction (XRD). Grain sizes and aspect ratios were measured using backscattered images from the SEM. Platelet grains were sized on the basis of equivalent circular diameter while all other grains were sized on the basis of number average particle diameter.

The microstructure of K420 consisted of tungsten carbide, a solid solution cubic carbide ((Ti, Ta, W)C) and a cobalt-tungsten binder, similar to ours, but much different actually, due to our ultrafine grain sizes of the WC and the solid solution employed. Fifty-one volume percent of their material was WC with a number average particle diameter of 1.1 micrometers. The WC morphology was angular with an effective aspect ratio of about 1. Thirty-six volume percent was solid solution carbide ((Ti, Ta, W)C) with the composition 20 wt % Ti, 31% Ta, 39% W, and 10% C having a number average particle diameter of 1.3 micrometers. Ten volume percent of the material was cobalt binder with a tungsten content of 19 wt %.

Preparation of Starting Powder CWC-050

A reactive particulate mixture containing tungsten trioxide ($WO_3$) (Scopino Yellow Oxide obtained from TACOW Trade Consultants, Ltd. Hockessin, Del.), tantalum pentoxide ($Ta_2O_5$) (Zhuzhou - Grade FTa2O5 obtained from TACOW Trade Consultants, Ltd. Hockessin, Del.), titanium dioxide ($TiO_2$) (Kronos K3020 obtained from Matteson-Ridolfi, Riverview, Mich.), and carbon black (C) (Chevron Shawinigan Acetylene Black) was prepared by ball milling. The reactive particulate mixture contained 14.78 kg of $WO_3$, 1.79 kg of $Ta_2O_5$, 2.08 kg of $TiO_2$, and 3.95 kg of C and was ball milled for 1 hour in a 40 gallon ball mill that contained 400 lbs. of 0.5 inch (12.7 mm) diameter WC-6% Co milling media. After ball milling, the powder mixture was passed through a coarse (8 mesh, 2.36 mm) screen to remove the milling media.

Twenty-two (22.0) kg of the reactant particulate mixture prepared above were loaded into the feed hopper of a vertical graphite tube reaction furnace of the type disclosed in U.S. Pat. Nos. 5,110,565 and 5,380,688. The furnace tube was 3.35 meters (m) long and had a 15.2 centimeter (cm) inside diameter. The feed hopper was connected to the cooled reactant transport member of the furnace by a twin screw loss-in-weight feeder. The reactant transport member had an inside diameter of 1.3 cm and was maintained at a temperature of approximately 283 K by water flowing through a cooling jacket surrounding the reactant transport member. The feed hopper was purged with argon gas for 30 minutes after the reactive particulate mixture was loaded into it, while the furnace tube was brought to a temperature of 2083 K as measured by optical pyrometers viewing the outside wall of the reaction chamber. Argon gas flowed into the reactant transport member at a rate of 3 scfm (85.05 slm).

The reactive particulate mixture was then fed from the feed hopper into the cooled reactant transport member at a rate of 10 kg per hour (22 lbs. per hour) by the twin screw feeder. The flowing argon gas entrained the particulate mixture and delivered it to the reaction chamber as a dust cloud. The particulate mixture was immediately heated in the reaction chamber at a rate of approximately 10,000 to 100,000,000 K per second. The average residence time of the reactive particulate mixture in the furnace was between 3 and 4 seconds.

After exiting the hot zone of the reaction chamber, the flowing argon and carbon monoxide (generated during the carbothermal reduction reaction) gas mixture carried the product (referred to as precursor) into a water cooled stainless steel jacket that rapidly cooled the precursor below 283 K. After exiting the reactor, the precursor was collected in a plastic bag that was inserted in a stainless steel drum.

In order to produce a usable final powder product the solid solution precursor was subjected to a second or finishing step. 500 g of the precursor synthesized above was homogenized by ball milling in a 1.6 gallon ball mill for 2 hours with 9.0 kg of 12.7 mm diameter WC-6% Co milling media. After homogenization the oxygen and carbon contents were measured by LECO analyzer to be 2.36 wt % and 6.71 wt %, respectively. 12.4 g of C (Chevron Shawinigan Acetylene Black) were then added to the homogenized precursor and the mixture was ball milled for an additional 2 hours. The precursor/carbon mixture was then heat treated at 1773 K for 30 minutes in a graphite furnace. This finishing treatment was done in a flowing (15 scfh) atmosphere of 95% argon and 5% hydrogen.

After the finishing treatment the oxygen and carbon contents of the final product were measured by LECO to be 0.26 wt % and 7.53 wt %, respectively. X-ray diffraction of the final product showed the presence of both WC and a cubic (Ti, Ta, W)C solid solution carbide. Analysis of the final product by scanning electron microscopy (SEM) showed a crystallite number average diameter of 0.060±0.024 micrometers (range of 0.02 to 0.12 micrometers) based upon the measurement of 112 randomly selected particles. The weight ratio of WC:TiC:TaC in this powder was approximately 8:1:1.

Preparation of Starting Powder CWC-059

Example 1: CWC-050-C was repeated, save increasing the amount of precursor and carbon that was subjected to the finishing treatment to 1.2 kg and 29.6 g, respectively. The oxygen and carbon contents of the final product were measured via LECO analyzer to be 0.31 wt % and 7.62 wt %, respectively. X-ray diffraction of the final product showed the presence of both WC and a cubic (Ti, Ta, W)C solid solution carbide. Analysis of the final product by scanning electron microscopy (SEM) showed a crystallite number average diameter of 0.044±0.014 micrometers (range of 0.02 to 0.08 micrometers) based upon the measurement of 105 randomly selected particles. The weight ratio of WC:TiC:TaC in this powder was approximately 8:1:1.

Example 3:CWC-060

Example 1: CWC-050 was repeated save for changing the composition of the reactive particulate mixture to 5.72 kg of $WO_3$, 6.44 kg of $TiO_2$ (Degussa P25 instead of Kronos K3020), 5.53 kg of $Ta_2O_5$, and 4.99 kg of C. The reactive particulate mixture was ball milled and reacted as previously described above in example 1: CWC-050. Again, the approximate heating rate and residence time were 10,000 to 100,000,000 K per second and 3 to 4 seconds, respectively. 1055 g of the precursor was homogenized and the oxygen and carbon contents were measured via LECO analyzer to be 4.88 wt % and 12.04 wt %, respectively. 14.11 g of C were added to the precursor and the mixture was ball milled for an additional 2 hours. The precursor/C mixture was then finished using the same procedure as was described above in example 1: CWC-050 save for increasing the temperature to 1873 K and decreasing the time to 15 minutes.

After the finishing treatment, the oxygen and carbon contents of the final product were measured by LECO analyzer to be 0.33 wt % and 10.89 wt %, respectively. X-ray diffraction of the final product showed the presence a cubic (Ti, Ta, W)C solid solution carbide and a small amount of WC. Analysis of the final product by scanning electron microscopy (SEM) showed a crystallite number average diameter of 0.063±0.017 micrometers (range of 0.04 to 0.11 micrometers) based upon the measurement of 102 randomly selected particles. The weight ratio of WC:TiC:TaC in this powder was approximately 1:1:1.

Example 1 (AV1)

75 grams of Dow developmental solid solution carbide powder lot CWC-050, which is described above, 13 grams of commercially available WC powder (Tokyo Tungsten grade 02N from Tokyo Tungsten, of Japan) with a crystallite number average (CNA) diameter of 0.12 micrometers, 3.5 grams of commercially available TaC powder (H. C. Stark lot 25029 from H. C. Stark. of Germany) with a Fisher Sub-sieve grain size of 1.5 micrometers, and 8.5 grams cobalt powder (H. C. Stark Grade II) with a Fisher Sub-sieve grain size of 1.5 micrometers were milled in an attritor for 6 hours. The attritor contained 3817 g of WC/Co balls in 200 ml heptane. Paraffin wax (2.0% by weight) was added during the last 1 hour of attritor mixing. The attrited powder was dried using a rotary evaporator and was passed through a 40 mesh (Tyler equivalent) screen.

Greenware parts were made by cold pressing the powder in steel tooling at 24,000 psi (165 MPa) to provide a part having a diameter of 19.13 mm and a height of 8.57 mm. The greenware was then placed inside a graphite crucible on a layer of WC crystals and sintered inside a graphite vacuum furnace. The heating cycle consisted of two main segments. The first segment was conducted under vacuum. The greenware was heated at 1.5 K/min from room temperature to 543 K where the temperature was held for 5 minutes. This segment was used to remove the paraffin wax from the part. After this, the furnace temperature was increased to 1373 K at 5 K/min. At 1373 K, the furnace temperature was held constant for 30 minutes to allow the sample to completely de-gas. The second segment of the sintering cycle started at this point with an introduction of argon gas into the vacuum furnace. The argon gas flow was adjusted so that a partial vacuum of 1 torr was maintained during the remaining segment of the sintering cycle. The temperature was then increased to 1733 K at 3 K/min. At 1733 K, the temperature was held for 30 minutes to allow the part to be sintered and completely densified.

Physical property testing of the sintered part provided the following results:

Density: 12.61 g/cm$^3$ Hardness, Vickers (31.8 kg load, 15 sec dwell): 1713±19 kg/mm$^2$ Palmqvist Toughness (31.8 kg load): 78.3±2.1 kg/mm The sintered microstructure consisted of tungsten carbide, a solid solution cubic carbide (Ti,Ta,W)C and a cobalt-tungsten binder, and contained no voids. Thirteen volume percent of the material was WC with a number average particle diameter of 0.30 micrometers. Forty-eight volume percent was WC having a platelet morphology with a number average equivalent circular diameter of 0.80 micrometers and an average aspect ratio of 2.4. Thirty volume percent was solid solution carbide ((Ti,Ta,W)C) with the composition 23 wt % Ti, 36 wt % Ta, 31 wt % W, and 10% C having a number average particle diameter of 0.77 micrometers. Nine volume percent of the material was cobalt binder with a tungsten content of 8 wt %.

Example 2 (EJL)

457.5 grams of Dow developmental solid solution carbide powder lot CWC-059 which is described above, and 42.5 grams of commercially available cobalt metal powder (H. C. Stark grade II) with a Fisher Sub-sieve grain size of 1.5 micrometers were milled in an attritor for 6 hours. The attritor contained 6960 g of WC/Co balls in 400 ml heptane. Paraffin wax (2.0% by weight) was added during the last 1 hour of attritor mixing. The attrited powder was dried using a rotary evaporator and was passed through a 40 mesh (Tyler equivalent) screen.

Greenware parts were made by cold pressing the powder in steel tooling at 23 ksi (159 MPa) to provide parts having a size of 8.1 mm×8.4 mm×24 mm. A second greenware shape was made by cold pressing the powder in steel tooling at 5.1 ksi (35 MPa), and cold isostatically pressing at 24 ksi (166 MPa), to provide parts having a size of 41 mm×10 mm×109 mm.

The parts were then placed inside a graphite crucible and sintered inside a tungsten vacuum furnace. The heating cycle consisted of two main segments. The first segment was conducted under vacuum. The parts were heated at 1.5 K/min to 543 K where the temperature was held for 5 minutes. This segment was used to remove the paraffin wax from the greenware. After this, the furnace temperature was increased to 1073 K at 5 K/min. At 1073 K, the furnace temperature was held constant for 45 minutes. The temperature was then increased to 1373 K at 3 K/min. At 1373 K, the temperature was held constant for 30 minutes to allow the parts to completely de-gas. The second segment of the sintering cycle started at this point with an introduction of argon gas into the vacuum furnace. The argon gas flow was adjusted so that a partial vacuum of 1 torr was maintained during the remaining segment of the sintering cycle. The temperature was then increased to 1723 K at 3 K/min. At 1723 K, the temperature was held for 30 minutes to allow the parts to be sintered and fully densified.

The sintered parts were wrapped in graphite foil and placed into a fluid die surrounded by Pyrex brand glass (Corning Glass Works). The fluid die was placed into a furnace at 1548 K for 2.5 hours. The furnace atmosphere was nitrogen. The heated fluid die was isostatically pressed at 830 MPa with a time of 10 seconds. The pressing procedure is described in more detail in U.S. Pat. No. 4,744,943 at column 1, lines 41–67, column 5, line 27 through column 6, line 16 and column 7 line 20 through column 10 line 40; U.S. Pat. No. 4,428,906 at column 3, line 6 through column 6, line 32; and U.S. Pat. No. 4,656,002 at column 3, line 22 through column 5, line 6. The fluid die was cooled in air before the parts were removed by gently breaking the cooled die and lightly grit blasting any remaining graphite foil or glass from the parts.

Physical property testing of the densified part gave the following results:

Density: 12.13±0.03 g/cm$^3$ Hardness, Vickers(31.8 kg load, 15 sec dwell): 1656±12 kg/mm$^2$ Palmqvist Toughness (31.8 kg load): 71.1±0.6 kg/mm Transverse Rupture Strength: 2132±68 MPa The sintered microstructure consisted of tungsten carbide, a solid solution cubic carbide ((Ti,Ta,W)C) and a cobalt-tungsten binder, and contained no voids. Fourteen volume percent of the material was WC with a number average particle diameter of 0.28 micrometers. Thirty-nine volume percent was WC having a platelet morphology with a number average equivalent circular diameter of 0.78 micrometers and an average aspect ratio of 2.2. Thirty-eight volume percent was solid solution carbide ((Ti, Ta, W)C) with the composition 23 wt % Ti, 25 wt % Ta, 42 wt % W, and 10 wt % C having a number average particle diameter of 0.71 micrometers. Nine volume percent of the material was cobalt binder with a tungsten content of 7 wt %.

Example 3 (EJO)

327.5 grams of commercially available WC powder (Tokyo Tungsten grade 02N) with a CNA diameter of 0.12 micrometers, 112.5 g of Dow developmental solid solution carbide powder lot CWC-060, which is described in above, 17.5 g of commercially available TaC powder (H. C. Stark lot 25029) with a Fisher Sub-sieve grain size of 1.5 micrometers, and 42.5 grams of commercially available cobalt metal powder (H. C. Stark grade II) with a Fisher Sub-sieve grain size of 1.5 micrometers were milled in an attritor for 6 hours. The attritor contained 6960 g of WC/Co balls in 400 ml heptane. Paraffin wax (2.0% by weight) was added during the last 1 hour of attritor mixing. The attrited powder was dried using a rotary evaporator and was passed through a 40 mesh screen.

The powder was used to make greenware parts as described in Example 2. The parts were sintered, ROC'd and recovered as described in Example 2.

Physical property testing of the densified part gave the following results:

Density: 12.56±0.02 g/cm$^3$ Hardness, Vickers (31.8 kg load, 15 sec dwell): 1849±21 kg/mm$^2$ Palmqvist Toughness (31.8 kg load): 64.5±0.6 kg/mm Transverse Rupture Strength: 1404±156 MPa The sintered microstructure consisted of tungsten carbide, a solid solution carbide ((Ti,Ta,W)C) and a cobalt-tungsten binder, and contained no voids. Thirty-one volume percent of the material was WC with a number average particle diameter of 0.16 micrometers. Twenty-six volume percent was WC having a platelet morphology with a number average equivalent circular diameter of 0.39 micrometers and an average aspect ratio of 1.8. Thirty-two volume percent was solid solution carbide ((Ti,Ta,W)C) with the composition 21 wt % Ti, 38 wt % Ta, 31 wt % W and 10 wt % C and having a number average particle diameter of 0.63 micrometers. Eleven volume percent of the material was cobalt binder with a tungsten content of 6 wt %.

Example 4 (EJP)

327.5 grams of commercially available WC powder (General Electric of Cleveland, Ohio) with a Fisher Sub-sieve grain size of 1.55 micrometers, 112.5 g of Dow developmental solid solution carbide powder lot CWC-060 which is described above, 17.5 g of commercially available TaC powder (H. C. Stark lot 25029) with a Fisher Sub-sieve grain size of 1.5 micrometers, 42.5 grams of commercially available cobalt metal powder (H. C. Stark grade II) with a Fisher Sub-sieve grain size of 1.5 micrometers, and 0.23 g carbon (Chevron Shawinigan Acetylene Black) were milled in an attritor for 6 hours. The attritor contained 6960 g of WC/Co balls in 400 ml heptane. Paraffin wax (2.0% by weight) was added during the last 1 hour of attritor mixing. The attrited powder was dried using a rotary evaporator and was passed through a 40 mesh screen.

The powder was used to make greenware parts as described in Example 2. The parts were sintered, ROC'd and recovered as described in Example 2.

Physical property testing of the densified part gave the following results:

Density: 12.65±0.02 g/cm$^3$ Hardness, Vickers (31.8 kg load, 15 sec dwell): 1635±15 kg/mm$^2$ Palmqvist Toughness (31.8 kg load): 78.1±2.6 kg/mm Transverse Rupture Strength: 2222±294 MPa The sintered microstructure consisted of tungsten carbide, a solid solution cubic carbide ((Ti,Ta,W)C) and a cobalt-tungsten binder, and contained no voids. Fifty-nine volume percent of the material was WC with a number average particle diameter of 0.66 micrometers. This WC had an angular morphology and an effective aspect ratio of 1. Thirty volume percent was solid solution carbide ((Ti,Ta,W)C) with the composition 21 wt % Ti, 35 wt % Ta, 35 wt % W, and 10 wt % C with a number average particle diameter of 0.80 micrometers. Eleven volume percent of the material was cobalt binder with a tungsten content of 5 wt %.

Example 5 (AR2)

327.5 grams of commercially available WC powder (Tokyo Tungsten grade 02N) with a CNA diameter of 0.12 micrometers, 112.5 g of commercially available solid solution carbide powder having a TiC-TaC-WC weight ratio of 1:1:1 (Tokyo Tungsten) and a Fisher Sub-sieve grain size of 2 micrometers, 17.5 g of commercially available TaC powder (H. C. Stark lot 25029) with a Fisher Sub-sieve grain size of 1.5 micrometers, and 42.5 grams of commercially available cobalt metal powder (H. C. Stark grade II) with a Fisher Sub-sieve grain size of 1.5 micrometers were milled in an attritor for 6 hours. The attritor contained 6960 g of WC/Co balls in 400 ml heptane. Paraffin wax (2.0% by weight) was added during the last 1 hour of attritor mixing. The attrited powder was dried using a rotary evaporator and was passed through a 40 mesh screen.

Greenware parts were fabricated and sintered as described in example 1 with the exception that the final sintering temperature was 1673 K.

Physical property testing of the densified part gave the following results:

Density: 12.32 g/cm$^3$ Hardness, Vickers (31.8 kg load, 15 sec dwell): 2001±18 kg/mm$^2$ Palmqvist Toughness (31.8 kg load): 57.9±0.2 kg/mm The sintered microstructure consisted of tungsten carbide, a solid solution cubic carbide ((Ti, Ta, W)C) and a cobalt-tungsten binder, and contained no voids. Forty-four volume percent of the material was WC with a number average particle diameter of 0.12 micrometers. Fourteen volume percent was WC having a platelet morphology with a number average equivalent circular diameter of 0.37 micrometers and an average aspect ratio of 1.8. Thirty-three volume percent was solid solution carbide ((Ti, Ta, W)C) with the composition 20 wt % Ti, 28 wt % Ta, 42 wt % W, and 10 wt % C having a number average particle diameter of 0.65 micrometers. Nine volume percent of the material was cobalt binder with a tungsten content of 22 wt %.

Resultant Cutting Tool Tests and Their Results

Densified parts from examples 2, 3, and 4 were sliced into blanks and ground into metal cutting inserts using a semi-automatic universal insert grinder manufactured by Wit-O-Matic Corp. of Novi, Mich. The inserts had an ANSI geometry designation of CNG432 and possessed a very light (<0.03 mm) edge hone. These uncoated inserts were used to cut hardened 4140 alloy steel (Rockwell "C" hardness of 31) on a CNC turning machine. The cutting conditions (2.54 mm depth of cut, 0.38 mm feed per revolution, neg. 5 degree rake angle, flood cooling, and speeds between 61 and 122 surface meter per minute [see Table I]) were typical of standard metal roughing operations. The cutting inserts did not fracture, chip, or otherwise fail prematurely. The useful lifetimes, as determined by the time required to reach 0.25 mm wear on either the tool flank or nose, are shown in Table I. These lifetimes are similar to what would be expected from a better commercial steel cutting insert.

TABLE 1

| Composition | Roughing Speed (meter per min.) | Lifetime (min. until 0.25 mm wear) |
|---|---|---|
| Example 2 | 73 | 15 |
| | 122 | 4.5 |
| Example 3 | 73 | 11 |
| | 122 | 3.5 |
| Example 4 | 61 | 18 |
| | 122 | 5.0 |

Hot Deformation Resistance Test

A densified part from Example 3 and the commercially available (Ti,Ta,W)C/Co solid solution material from Comparative Example were ground flat and polished to a mirror finish with diamond paste. These specimens were tested at 1073 K to measure the hot hardness of the material. The procedures used to measure the hot hardness followed the guidelines described in ASTM Standard E10-84 entitled "Standard Test Method for Brinell Hardness of Metallic Materials". In this test method, a 9.89 mm tungsten carbide/Cobalt ball was placed on top of the polished flat surface of the specimen. The specimen/ball arrangement was placed into a graphite furnace equipped with hydraulic loading rams. A preload of 1000 lbs was placed onto the ball/specimen arrangement by the hydraulic rams. The furnace was evacuated and backfilled with flowing Argon gas. The hot hardness specimen was heated to 973 K at 20 K/min followed by a 5 K/min heating rate to 1073 K. After a soak period of 10 minutes at 1073 K. The load on top of the ball was increased to 2675 $kg_f$ using a loading rate of 7930 $kg_f$/min. The 2675 $kg_f$ load was held for 15 seconds before the specimen was unloaded at a rate of 5255 $kg_f$/min. At this point, the power to the furnace was shut-off and the sample allowed to cool to room temperature.

The hot hardness was then determined by measuring the diameter of the impression left by the ball on polished surface of the specimen. This diameter was used to calculate a Brinell hardness number (HB) using the following equation:

$$HB=2L/[(pD)(D-(D^2-d^2)^{1/2})]$$

where L is the applied load ($kg_f$), D is the diameter of the ball (mm) and d is the mean diameter (mm) of the impression on the flat surface. According to this equation, an impression with a smaller diameter would be indicative of a material with a higher Brinell Hardness Number. The results of this test are summarized in the following table:

| Material | Brinell Hardness Number (HB) |
|---|---|
| Example 3 | 630 |
| Comparative Example | 560 |

The material from example 3 was found to have a significantly higher hardness at 1073 K compared to the commercially available cutting tool material. This increased hot hardness is the result of the WC and (Ti,Ta,W)C grains having a much smaller size than the microstructure found in the commercially available material. Increased hot hardness has been shown to be beneficial in the cutting of steels. The ability to develop this finer microstructure (which results in better hot hardness than the commercial material) is the direct result of using ultrafine (Ti,Ta,W)C and WC powders to makeup the material.

The materials of examples 1–5 show several microstrucural features which are different from the prior cutting tool material of the Comparative Example. The materials of examples 1, 2, 4, and 5 show a duplex grain structure in the WC phase whereas the prior art material of the Comparative Example has a single type of WC phase with angular morphology with a number average particle diameter of 1.1 micrometers and an effective aspect ratio of about 1. The coarser WC in the material of examples 1, 2, 3, and 5 has a plate morphology which is not found in commercial cutting tool materials, such as the material of the Comparative Example, with similar overall composition. The WC plates in the materials of examples 1, 2, 3, and 5 have number average equivalent spherical diameters of 0.37 to 0.78 micrometers, and aspect ratios of 1.8 to 2.4. The finer WC in examples 1, 2, 4, and 5 is faceted and angular with a number average particle diameter of 0.12–0.31 micrometers. The materials of examples 1–5 have a submicron solid solution carbide phase ((Ti, Ta, W)C), whereas the prior art material of the Comparative Example has a solid solution carbide phase with a number average particle diameter of greater than 1 micrometers. The tungsten content in the cobalt binder phase is significantly lower in the materials of examples 1–4 which all contained Dow developmental solid solution carbide powders in the starting powder mixtures, compared to the commercial material of the Comparative Example. The materials of examples 1–5 show higher hardnesses than the material of this Comparative Example.

Thus, there is a tool, method of making the tool, and the material disclosed by the present invention that fulfills the advantages described above. The tool has superior wear and hardness characteristics, and shows other superior properties which render the present invention economically and scientifically superior to its prior art precedessors. The following claims delineate the invention, and none of the previous description is to narrow the scope of the invention.

What is claimed is:

1. A multi-phase cemented ceramic article having improved characteristics, comprising:

a material including a) at least two types of hard phase constituents, including i) a first type of hard phase constituent selected from the group consisting of the carbides, nitrides, carbonitrides, carboxynitrides, and mixtures thereof of Group IVB (Ti, Zr, Hf), Group VB (V, Nb, Ta), Group VIB (Cr, Mo and W) transition metals, wherein there are substantially discrete ranges of grain sizes within the first type of hard phase constituent, said first type of hard phase constituent being made of predominantly two separate grain sizes, the first grain size being from about 2.0 to 4.0 times the size of the second grain size;

ii) a second type of ultrafine solid solution hard phase constituent, wherein the ultrafine solid solution hard phase is in the form of grains having a number average particle diameter of between about 0.01 and about 1.0 micrometers, said solid solution hard phase constituent selected from the group consisting of the carbides, nitrides, carbonitrides, carboxynitrides, and combinations thereof, of at least two metallic elements from Group IVB (Ti, Zr, Hf), Group VB (V, Nb, Ta), and Group VIB (Cr, Mo and W) transition metals; and b) a metallic binder phase selected from the group consisting of Group VIII elements (Co, Ni, Fe), Group IVB (Cr, Mo, W) and mixtures thereof; said two types of hard phase constituents and the metallic binder phase being substantially homogeneously distributed throughout the bulk of the tool.

2. The article of claim 1, wherein the first hard phase constituents include platelets.

3. The article of claim 2, wherein the first hard phase constituent platelets have an average aspect ratio ranging from about 1.5 to about 3.0.

4. The article of claim 2, wherein the first hard phase constituent platelets have a number average equivalent circular diameter of between about 0.30 to about 0.85 micrometers.

5. The article of claim 1, wherein the first type of constituent includes tungsten carbide.

6. The article of claim 1, wherein the second type of hard phase constituent includes a solid solution of the carbides of titanium, tantalum and tungsten.

7. The article of claim 6, wherein the weight percentages of the resulting individual metallic elements of the (Ti,Ta, WC) solid solution include about 10% to about 40% by weight titanium, from about 10% to about 40% by weight of tantalum, and from about 20% to about 60% by weight of tungsten, within the solid solution carbide in the bulk of the article.

8. The article of claim 1, wherein the multiple phases in the finished tool include a fine tungsten carbide phase, a coarse tungsten carbide phase, a solid solution phase of (Ti, Ta, W)C, and a cobalt-containing metallic binder phase.

9. The article of claim 8, wherein the volume percentages of each of the phases in the finished article range from about 10% to about 50% fine tungsten carbide, from about 10% to about 75% coarse tungsten carbide, from about 10% to about 50% solid solution of the carbides of titanium, tantalum and tungsten, and from about 5 to about 30% binder phase.

10. The article of claim 1, wherein the metallic binder phase in the finished article includes cobalt with a minor amount of tungsten therein, said minor amount being from about 4% to about 15%, by weight.

11. A multi-phase cemented ceramic having improved characteristics, comprising:

a material including a) at least two types of hard phase constituents, including i) a first type of hard phase constituent consisting of tungsten carbide, present in the amounts of between about 50% and about 80%, by volume in the bulk of the resultant article;

ii) a second type of ultrafine solid solution hard phase constituent including a solid solution of the carbides of titanium, tantalum and tungsten present in the amount of between about 10% and about 50%, by volume in the bulk of the resultant article; and iii) cobalt binder phase, present in the amount of between about 5% and about 30%, by volume in the bulk of the resultant article;

whereby the article is composed of a material including multiple phases, after sintering, selected from the group consisting of platelets of a coarse tungsten carbide, fine tungsten carbide grains of a size between about 0.10 and about 0.40 micrometers, and a relatively low tungsten concentration in the cobalt binder phase.

12. A multi-phase cemented ceramic material wherein there are substantially discrete ranges of grain sizes within the first type of hard phase constituent, said first type of hard phase constituent being made of predominantly two separate grain sizes, the first grain size being from about 2.0 to 4.0 times the size of the second grain size comprising:

a) at least two types of hard phase constituents, including i) a first type of hard phase constituent selected from the group consisting of the carbides, nitrides, carbonitrides, carboxynitrides, and mixtures thereof of Group IVB (Ti, Zr, Hf), Group VB (V, Nb, Ta), Group VIB (Cr, Mo and W) transition metals;

ii) a second type of ultrafine solid solution hard phase constituent, wherein the ultrafine solid solution hard phase is made from grains having a number average particle diameter of between about 0.01 and about 1.0 micrometers, said solid solution hard phase constituent selected from the group consisting of the carbides, nitrides, carbonitrides, carboxynitrides, and combinations thereof, of at least two metallic elements from Group IVB (Ti, Zr, Hf), Group VB (V, Nb, Ta), and Group VIB (Cr, Mo and W) transition metals; and b) a metallic binder phase selected from the group consisting of Group VIII elements (Co, Ni, Fe), Group IVB (Cr, Mo, W) and mixtures thereof;

whereby a material is produced which, when homogeneously mixed, pressed and sintered, exhibits superior hardness.

13. The material of claim 12, wherein the first hard phase constituents include platelets.

14. The material of claim 13, wherein the first hard phase constituent platelets have an average aspect ratio ranging from about 1.5 to about 3.0.

15. The material of claim 13, wherein the first hard phase constituent platelets have a number average equivalent circular diameter of between about 0.30 to about 0.85 micrometers.

16. The material of claim 12, wherein the first type of constituent includes tungsten carbide.

17. The material of claim 12, wherein the second type of hard phase constituent includes a solid solution of the carbides of titanium, tantalum and tungsten.

18. The material of claim 17, wherein the weight percentages of the resulting individual metallic elements of the (Ti,Ta,W)C solid solution include about 10% to about 40% by weight titanium, from about 10% to about 40% by weight of tantalum, and from about 20% to about 60% by weight of tungsten, within the solid solution carbide in the bulk of the tool.

19. The material of claim 12, wherein the multiple phases in the resulting material include a fine tungsten carbide phase, a coarse tungsten carbide phase, a solid solution phase of (Ti, Ta, W)C, and a cobalt-containing metallic binder phase.

20. The material of claim 19, wherein the volume ratios of each of the phases in the resultant material range from about 10% to about 50% fine tungsten carbide, from about 10% to about 75% coarse tungsten carbide, from about 10% to about 50% solid solution of the carbides of titanium, tantalum and tungsten, and from about 5 to about 30% binder phase.

21. The material of claim 12, wherein the metallic binder phase in the resulting material includes cobalt with a minor amount of tungsten therein, said minor amount being from about 4% to about 15%, by weight.

22. The material of claim 12, wherein the hardness value is from about 1600 to about 2100 $Kg/mm^2$.

23. A multi-phase cemented ceramic material comprising:

a) a material including at least two types of hard phase constituents, including i) a first type of hard phase constituent consisting of tungsten carbide present in the amounts of between about 50% and about 80%, by volume in the bulk of the resultant article;

ii) a second type of ultrafine solid solution hard phase constituent including a solid solution of the carbides of titanium, tantalum and tungsten present in the amount of between about 10% and about 50%, by volume in the bulk of the resultant article; and b) cobalt binder phase, present in the amount of between about 5% and about 30%, by volume in the bulk of the resultant article;

whereby the article is formed of a material including multiple phases, after sintering, selected from the group consisting of platelets of a coarse tungsten carbide, fine tungsten carbide grains of a size between about 0.10 and about 0.40 micrometers, and a relatively low tungsten concentration in the cobalt binder phase.

* * * * *